US007775387B2

(12) United States Patent
Lipton et al.

(10) Patent No.: US 7,775,387 B2
(45) Date of Patent: Aug. 17, 2010

(54) EYEWEAR RECEPTACLE

(75) Inventors: Lenny Lipton, Los Angeles, CA (US); Jill Cook, Agoura Hills, CA (US)

(73) Assignee: RealD Inc., Beverly Hills, CA (US)

( * ) Notice: Subject to any disclaimer, the term of this patent is extended or adjusted under 35 U.S.C. 154(b) by 9 days.

(21) Appl. No.: 11/644,444

(22) Filed: Dec. 21, 2006

(65) Prior Publication Data

US 2008/0149517 A1 Jun. 26, 2008

(51) Int. Cl.
*B65D 43/16* (2006.01)
*B65D 45/16* (2006.01)
*A47G 29/12* (2006.01)

(52) U.S. Cl. ..... 220/23.87; 220/213; 220/324; 220/835; 220/908; 232/1 R; 232/43.2

(58) Field of Classification Search ..... 220/200, 220/229, 324, 826, 835, 839, 213, 253, 908, 220/909, 23.87; 229/102.5, 120, 120.03, 229/121, 131.1; 232/1 R, 27, 43.2
See application file for complete search history.

(56) References Cited

U.S. PATENT DOCUMENTS 1,424,519 A * 8/1922 Richardson ..... 40/306
2,421,710 A * 6/1947 Mills ..... 232/1 R
3,238,953 A * 3/1966 Barbie ..... 453/63
3,650,384 A * 3/1972 Pegg ..... 211/1
3,854,656 A * 12/1974 Bishop et al. ..... 232/27
3,866,824 A * 2/1975 Lewis ..... 232/43.2
3,904,218 A * 9/1975 Kostic ..... 280/79.2
4,356,956 A * 11/1982 Long ..... 232/24
4,671,455 A 6/1987 Stockman
4,905,853 A * 3/1990 Strawder ..... 220/523
4,997,102 A * 3/1991 Bolling ..... 220/325
5,046,635 A * 9/1991 Haas et al. ..... 220/524
5,080,251 A * 1/1992 Noack ..... 206/366
5,205,430 A * 4/1993 Valyi ..... 220/278
5,219,085 A * 6/1993 Craft et al. ..... 220/252
5,624,050 A * 4/1997 Haas ..... 220/4.05
5,651,231 A * 7/1997 Garland ..... 53/258

(Continued)

FOREIGN PATENT DOCUMENTS

KR 200370714 Y1 12/2004

OTHER PUBLICATIONS

International Search Report and Written Opinion for PCT/US2007/025585 mailed Mar. 17, 2009.

(Continued)

*Primary Examiner*—Anthony Stashick
*Assistant Examiner*—Niki M Eloshway
(74) *Attorney, Agent, or Firm*—Baker & McKenzie LLP

(57) ABSTRACT

An apparatus for collecting selection devices or eyewear is provided. The apparatus comprises a collection bin component and at least one receptacle panel component or receptacle lid component positioned adjacent to said collection bin component. The at least one receptacle panel covers at least a portion of the collection bin component. The apparatus further includes receptacle panel openings formed in at least one receptacle panel component. Openings are arranged in proportions configured to receive the selection devices and enable the collection bin component to collect said selection devices. Signage may be provided in association with the apparatus.

10 Claims, 12 Drawing Sheets

U.S. PATENT DOCUMENTS 5,890,440 A * 4/1999 Spur ..... 109/47
6,047,843 A * 4/2000 Mecke ..... 220/23.88
6,116,977 A 9/2000 Tanny et al.
6,474,472 B1 * 11/2002 Shaw ..... 206/366
2005/0091893 A1 * 5/2005 Bruegmann ..... 40/606.15

OTHER PUBLICATIONS

International Preliminary Report on Patentability for PCT/US2007/025585 mailed Jul. 2, 2009.

* cited by examiner

EYEWEAR RECEPTACLE

BACKGROUND OF THE INVENTION

1. Field of the Invention

The present invention relates generally to the field of collection devices tailored to receive predefined items, and more specifically to an eyewear receptacle for collecting three-dimensional (3-D) eyewear selection devices returned by audience members as they exit a movie theater.

2. Description of the Related Art

Many of today's movie theaters currently exhibit films capable of rendering a three-dimensional (3-D) viewing experience. For audience members to properly view current projected stereoscopic motion pictures, each member must wear a selection device such as 3-D eyewear, also known as 3-D glasses. Movie theaters provide or 'hand-out' pairs of 3-D glasses to each audience member prior to viewing stereoscopic content such as films, movies, and images. The 3-D glasses currently provided by movie theaters are generally considered 'single-use-only' items. At the end of viewing the film, audience members typically dispose of each pair of 3-D glasses either by taking them home for storage in, for example, a drawer, or placing them into a receptacle such as a common trash container or barrel.

A major commercial problem with regard to providing 'single-use-only' 3-D glasses is the cost to continually provide new pairs of 3-D glasses to each audience member before viewing films containing stereoscopic content. As the number of stereoscopic films produced and distributed by studios each year continues to increase, so will the quantities of 3-D glasses distributed by theaters to their viewing audience members. It currently remains commonplace for movie theater operators to operate without requesting audience members to return the eyewear after viewing a stereoscopic film. The lack of an ongoing collection practice and mechanism by movie theater operators remains as a major contributor to lost inventory and increased costs of distribution.

A limited number of today's movie theater operators have put into place a collection practice and mechanism allowing audience members to return their 3-D glasses. However, these practices and mechanisms continue to experience a relatively high rate of inventory loss. For example, certain collection practices do not openly and outwardly direct audience members to return their glasses after use. Today's collection devices typically are unremarkable looking, and at times may resemble trash containers positioned in areas where audience members typically expect trash containers to be found. The appearance of today's collection devices does not provide sufficient awareness or indication to the viewing audience of the ability to return the 3-D glasses to the theater.

The ornamentation and physical placement associated with today's deployed collection devices leads to one of two common results: either the audience member is completely unaware that eyewear is being collected, or the audience member is aware that eyewear is being collected but does not see the receptacle designated for eyewear collection, possibly confusing the eyewear collector for a trash receptacle. Some audience members may have actually disposed of trash in the container intended to collect the eyewear. The result is recycled eyewear commingling with trash and other debris. At additional expense, movie theater operators must either separate the eyewear from the trash and debris or lose this inventory as unsalvageable. In addition, when collected eyewear comes in contact with trash and debris, the eyewear can quite easily become damaged, further contributing to the rate of inventory shrinkage. Lack of audience awareness and mistaken identification of the current class of collection devices significantly contribute to 3-D glasses being lost unnecessarily. Inventory losses experienced with today's uncollected or unreturned 3-D glasses increase the overall 3-D eyewear inventory costs borne by the parties contracted to distribute the eyewear.

The effects of the lack of a suitable collection device, lack of audience member awareness, mistaken collection device identity, and/or damage resulting from glasses commingled with trash and debris contribute to an increased rate of inventory shrinkage of 3-D glasses.

Based on the foregoing, it would be advantageous to provide an eyewear collection solution for use in aggregating used 3-D selection devices returned by audience members that overcome the foregoing drawbacks present in previously known designs used in movie theaters exhibiting stereoscopic films.

SUMMARY OF THE INVENTION

According to one aspect of the present design, there is provided an apparatus for collecting selection devices or eyewear. The apparatus comprises a collection bin component and at least one receptacle panel component or receptacle lid component positioned adjacent to said collection bin component. The at least one receptacle panel covers at least a portion of the collection bin component. The apparatus further includes receptacle panel openings formed in at least one receptacle panel component. Openings are arranged in proportions configured to receive the selection devices and enable the collection bin component to collect said selection devices. Signage may be provided in association with the apparatus.

These and other advantages of the present invention will become apparent to those skilled in the art from the following detailed description of the invention and the accompanying drawings.

BRIEF DESCRIPTION OF THE DRAWINGS

The present invention is illustrated by way of example, and not by way of limitation, in the figures of the accompanying drawings in which.

DETAILED DESCRIPTION OF THE INVENTION

Figure 1:
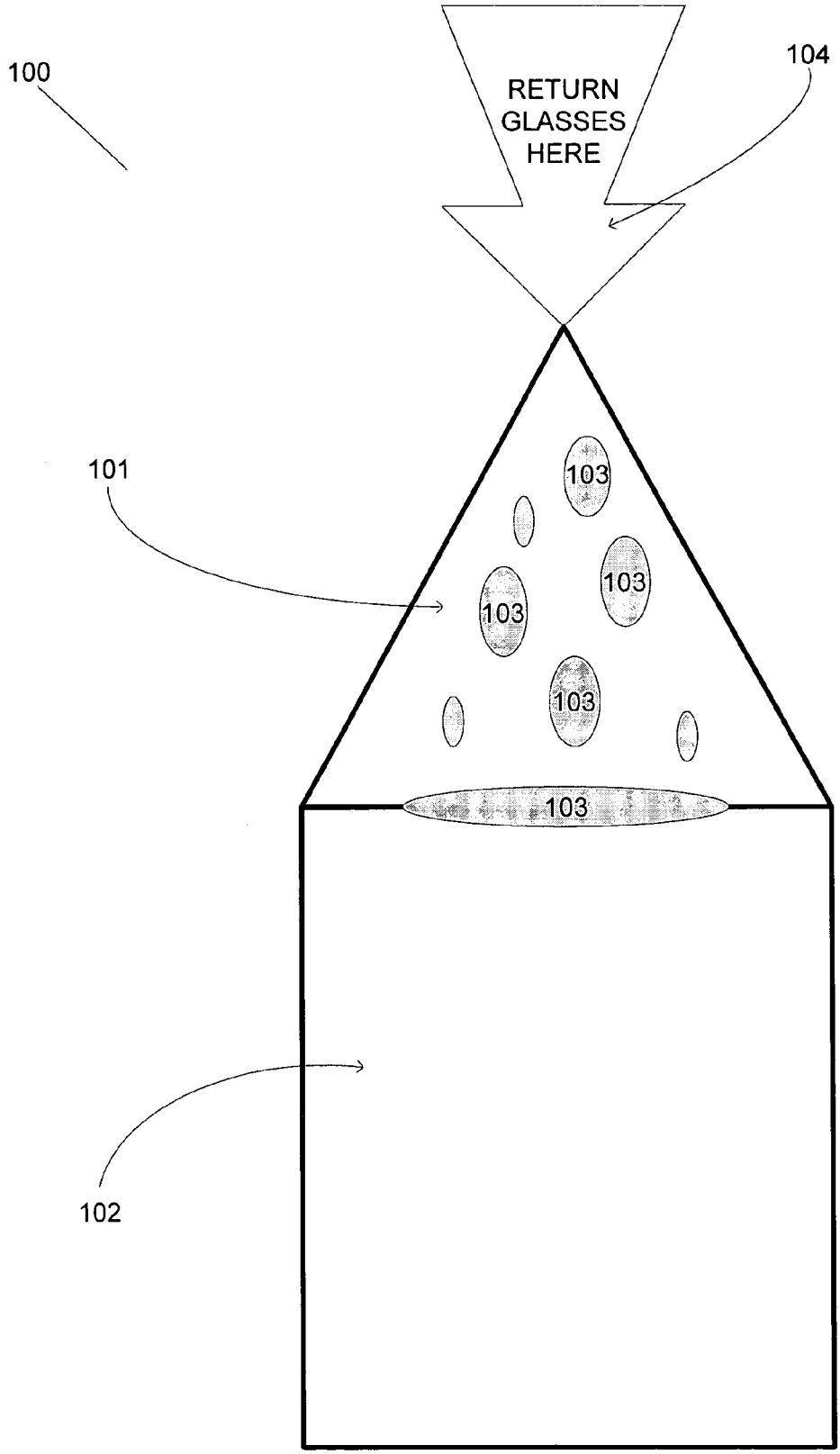
FIG. 1 is a side perspective view of one embodiment of the apparatus of the present invention illustrating a receptacle panel positioned on a collection bin.

The following description and the drawings illustrate specific embodiments sufficiently to enable those skilled in the art to practice the system and method described. Other embodiments may incorporate structural, logical, process and other changes. Examples merely typify possible variations. Individual components and functions are generally optional unless explicitly required, and the sequence of operations may vary. Portions and features of some embodiments may be included in or substituted for those of others.

The present design is an apparatus and method configured to recycle selection devices previously worn by viewing audience members, thus preparing the selection devices for reuse by newly attending audience members. Selection devices, i.e. 3-D eyewear or glasses, may include active eyewear designs, such as shuttering eyewear, and passive eyewear designs. As used herein "selection device(s)", "3-D eyewear", "3-D glasses" or just simply "eyewear" and similar terms all refer to devices worn by the audience members to properly view stereoscopic content, unless specifically described otherwise.

As may be appreciated, the eyewear discussed herein is typically of high quality, as opposed to single use or universally disposable eyewear, such as single use paper or cardboard eyewear. By providing high quality eyewear, such as hard plastic quality constructed eyewear, such eyewear may be cleaned and reused with excellent results. The eyewear of the present design is typically cleanable using a cleaning solution, heated water mixed with a product such as soap, or otherwise able to have dirt, oils, and other unwanted materials removed therefrom. Thus while many such types of eyewear may use the beneficial aspects disclosed herein, such eyewear may include hard plastic eyewear, hard plastic eyewear formed around metal, or formed from composite or other cleanable materials.

While the present design may be used in various environments and applications, it will be discussed herein with a particular emphasis on a movie theater environment, where audience members go to view stereoscopic image content. Other venues may employ the current design, including but not limited to theme parks, corporate sites, and so forth. In such environments, it is noted that frequency of eyewear distribution is of particular importance. In a situation such as a theme park, where a new viewing occurs three times every hour, and up to ten or more hours per day, patrons are provided with eyewear at a much more rapid rate than at a movie theater where four or even fewer showings per day are the norm. As a result, eyewear at a rapid turnover venue requires that a relatively large quantity of eyewear be available, while a smaller inventory may be maintained at a slow turnover venue. Thus recycling eyewear using on-site facilities at a high turnover venue can be inconvenient, as personnel must be available to constantly clean and reuse the eyewear, or alternately a high volume of inventory must be kept on hand to satisfy demand.

Eyewear Collection Receptacle

The present design is an apparatus configured to aggregate selection devices being returned by audience members after viewing a stereoscopic film, image, or movie. The present design may provide an eyewear receptacle 100 for use in collecting and storing any type of selection device, e.g. 3-D glasses, worn by the audience members including active eyewear designs, such as shuttering eyewear, and passive eyewear designs that may include linear and circular polarizing optics and constructed using cardboard, paper, plastic, plastic-framed or other kinds of eyewear. The apparatus of the present design may be configured to prevent undesirable articles, material or items from being deposited by the audience members into the present design, such as typical movie theater trash and other debris.

While the present receptacle design may be used in various environments and applications, it will be discussed herein with a particular emphasis on a movie theater environment, where audience members go to view stereoscopic content. For example, one embodiment of the present design may include a receptacle component that comprises one or more receptacle panels forming a flat top or lid portion over the receptacle, the flat lid formed to receive the desired items. Each receptacle panel may include a plurality of independent openings that may be geometrically arranged and sized to allow only selection devices to pass through the openings. The present design may affix or position the top or lid portion of the receptacle on a collection bin component configured to hold and store the returned eyewear. The collection bin may be secured using a lock or other security device suitable for protecting the contents of the collection bin. At the end of the business day or after a movie screening, movie operators may access and remove the returned or deposited eyewear by unlocking an opening the collection bin. Under normal operation, eyewear is removed in, for example, a standard sized shipping box within the bin when the box is full and ready to ship to the recycling center or central cleaning facility. In this manner, the eyewear does not need to be handled and transferred from one container to another, but simply fall right into the shipping carton.

The design may be made of plastic, such as a molded heavy duty (ABS) plastic. Alternatively, the container may be made of metal, such as sheet metal, but other materials may be used. The sides or panels of the design may be joined using conventional means, including but not limited to welding or bolting, but other materials may be used for some portion of or the entire receptacle. The lid portion can be affixed many different ways and removable from the container in various generally known configurations all within the scope of the current invention. For example, a top or lid may be provided that is hinged or held in place by interlocking components, tongue and groove type arrangements, and the top portion may be affixed using mechanical retaining bars making removal difficult, or a magnetic attachment/release arrangement may be employed, among other solutions. The present invention is not limited by the specific embodiments presented herein.

Figure 2A:
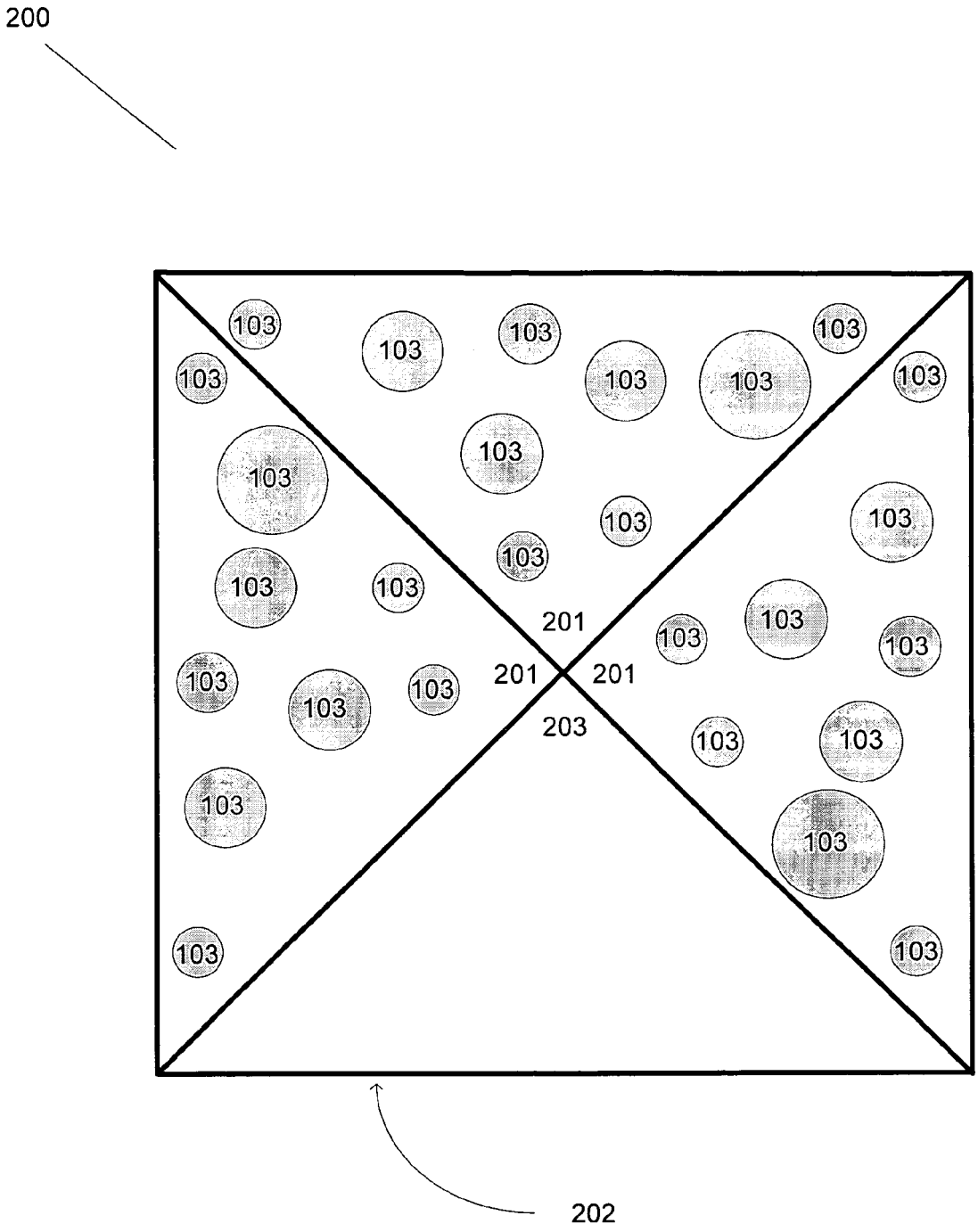
FIG. 2A is a top perspective view of four receptacle panels configured to form the top of the apparatus of the present invention for the embodiment shown in FIG. 1.

FIG. 1 is a side perspective view of one embodiment of the apparatus illustrating a receptacle panel 101 positioned on top of a collection bin 102. In this arrangement, the present design may position or situate at least one receptacle panel 101 onto a collection bin 102. The receptacle panels 101 may be arranged to operate as one fixed unit, or may be arranged to operate as separate individual panels. The apparatus may be constructed such that all receptacle panels 101 employed on each side of the apparatus are identical, or only one, two, three, or some subset of the total number of panels may be configured with receptacle panels similar to receptacle panel 101. When configured with only a subset of receptacle panels, the present design may include a blank or unperforated panel 203 in lieu of a receptacle panel 101 as illustrated in FIG. 2A. Use of a blank panel 203 may be desirable in the situation where, for example, the eyewear receptacle 100 is located against a solid wall. Receptacle panels 101 of the present design may include a plurality of openings 103 configured in various shapes and sizes proportioned to allow only 3-D eyewear to be ultimately placed in the collection bin 102.

The design of FIG. 1 is dimensioned such that the top can invert and be placed into the bottom—for easy storage, assembly, disassembly and shipping, such as shipping of the container to the theatre or venue. Such dimensioning is not required but can make for ease of manufacture, transportation, setup, and/or use.

In this arrangement, the top 200 of the apparatus, for example, may include three receptacle panels 201 and one blank panel 203 configured to form a pyramid structure 202, as illustrated in FIG. 2A, where each of the four sides of the pyramid structure 202 may form an isosceles triangle. Although illustrated as four isosceles triangles arranged to form the pyramid structure 202, the top 200 of the present design may include any workable configuration forming the receptacle panels 101 and joined to provide the top 200 of the apparatus. Each opening 103 of the apparatus may be realized using various shapes, including but not limited to ellipses, circles, rectangles, irregular shapes, etc., and vary the proportions of these shapes in a manner sufficient to prevent many undesirable articles from being passed through the receptacle panel 101 at openings 103. Undesirable articles in this context generally represent material or items other than the desired selection devices or eyewear, such as popcorn containers, soda containers, bottles, and so forth. Of course, a determined user may be able to put smaller items of trash into the receptacle, such as items smaller than the eyewear, but the general impression that the bin is not for trash is typically conveyed and understood by many patrons.

Locking may be provided by either providing an opening near the base of the top 200 where a conventional padlock may be inserted together with a hinge formed on the opposite side enabling the top to be rotated and the contents removed. Alternately, collection bin 102 may include a lockable or closable door or opening at the bottom of the top 200 or on a side of the top 200 that may be locked and hinged or otherwise opened to remove the contents. Other locking or retention mechanisms, including a lockable or closable door or opening on one side of collection bin 102, may be employed while within the scope of the present design.

Openings 103 may be arranged to allow audience members of a minimum height, such as children, to reach the lower openings 103 in a manner sufficient to deposit their used glasses. Arranging the openings 103 having this configuration at this minimum height can allow eyewear deposit while simultaneously prohibiting the deposit of inappropriate or undesirable items through the openings 103. The overall height of collection bin 102 in combination with receptacle panels 101 may enable both tall and short patrons easy and simultaneous access to eyewear receptacle 100, thus not impeding the ability of audience members to deposit their glasses in the receptacle and quickly exit the theater.

The construction of collection bin 102 further prevents already collected items from being removed or stolen from the collection bin. As shown in FIG. 1, glasses would typically drop a considerable distance from the lowest holes even when partially filled, and a typical person's or child's arm could not fit through openings 103 and retrieve many, if any, discarded glasses from the collection bin.

The receptacle panels combined to form the top 200 and the geometric shape of the openings 103 may form an ornamental 'eye-catching' visually distinctive appearance that may capture the attention of departing audience members indicating an expectation that the eyewear they received for viewing the movie are expected to be returned to the theater after use. The ornamental 'eye-catching' visually distinctive appearance formed by the present design to inform the audience members to return their eyewear may reduce the rate of inventory loss experienced by the movie theater operators.

Figure 2B:
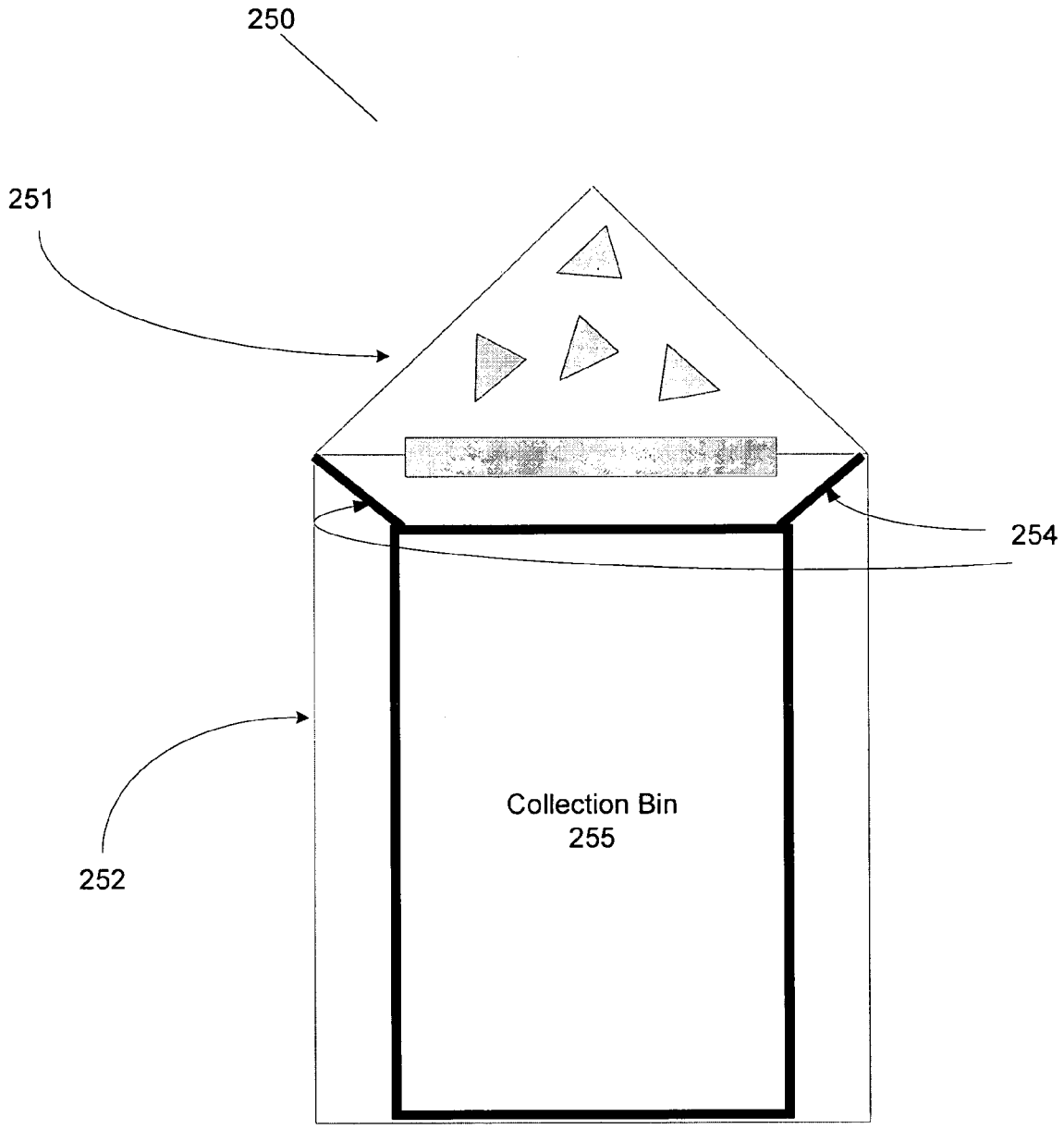
FIG. 2B illustrates an aspect of the current design using an optional internal standard shipping size collection receptacle and optional receiving hardware.

FIG. 2B illustrates a variation on the design of FIG. 2A having different internal components. Certain shipping entities use standard sized shipping containers and the design of FIG. 2B is provided to conceptually represent collection using such containers. FIG. 2B is a side perspective view of an alternate embodiment of the apparatus illustrating a receptacle panel 251 positioned on top of a bin 252. In this arrangement, an internal collection bin 255 may be employed that is of a standard size, such as used by certain shippers or the U.S. Post Office.

Note that collection bin 255 differs from collection bin 102 as it is inside bin 252. As used herein, the term "collection bin" is intended to be used broadly to mean a bin that collects the glasses or eyewear, and may comprise a component inside the entire structure as shown in FIG. 2A or may include the lower entire structure as shown in FIG. 1. The functionality of a "collection bin" is to collect the eyewear, and once the eyewear is collected, the "collection bin may be emptied or removed completely from the structure and transported to, for example, a cleaning facility.

If desired, optional directing elements 254 may be employed, providing the ability for glasses deposited in openings 256 to be directed to the collection bin 255 rather than fall to the ground. A typical arrangement has optional directing elements 254 extending from an edge or proximate an edge of the upper corners/edges of bin 252 downward to the top edges/corners of collection bin 255, but other geometries may be employed. Optional directing elements 254 may be unnecessary if the collection bin 255 is approximately as large or fits adequately within bin 255. Such a geometry may be realized if the bin 255 is standard size or slightly larger than a standard size shipping container.

In a square or substantially rectangular bin arrangement, four optional directing elements 254 may be provided, essentially forming a tray resembling, for example, a square with a square hole therein. The tray (not shown) is not completely flat but angled to some extent and has a slight downward slope. The tray helps prevent theft and helps guide the glasses into the shipping box or collection box 255, similar to the effect of a funnel.

A construction such as that shown in FIG. 2B provides an internal container or collection bin within the outer collection box or bin, where the internal container is used in shipping the eyewear to the central cleaning location. Such a feature can greatly simplify shipping and reduce labor costs.

Eyewear receptacle 100 may include signage 104 affixed to the top of a receptacle panel 101 of pyramid structure 202 as illustrated in FIG. 2A. Although signage 104 is illustrated as affixed to the top of receptacle panel 101 in FIG. 1, the present design may allow signage 104 to be affixed at other locations, including multiple locations, on or near receptacle panel 101. If desired, signage 104 may also be affixed to blank panel 203. In a similar manner, the present design may configure multiple signage 104 components and may have these components at one or more locations on collection bin 102, or any combination of receptacle panels 101, blank panels 203, and collection bin 102, or some other nearby location. Signage is optional and may include, but is not limited to, one or more pictures, images, symbols, text, colors, and other verbal elements, typically indicating that used eyewear may be deposited into the receptacle. The design of FIG. 2B shows an embodiment where no signage is employed. Wording or images on the signage may be as simple as "Used Glasses" or "Return Glasses Here" or a visual depiction of eyewear being placed in an eyewear receptacle, or may be more extensive.

The present design's use of signage 104, openings 103, and receptacle panels 101 to create an ornamental visually distinctive experience is intended to increase awareness and allow audience members to identify that eyewear receptacle 100 is the appropriate place for returning 3-D glasses. Improving audience member awareness and providing a means to allow easy and rapid identification of the eyewear receptacle 100 as the place for disposing of their 3-D glasses can reduce the rate of lost inventory.

Figure 3:
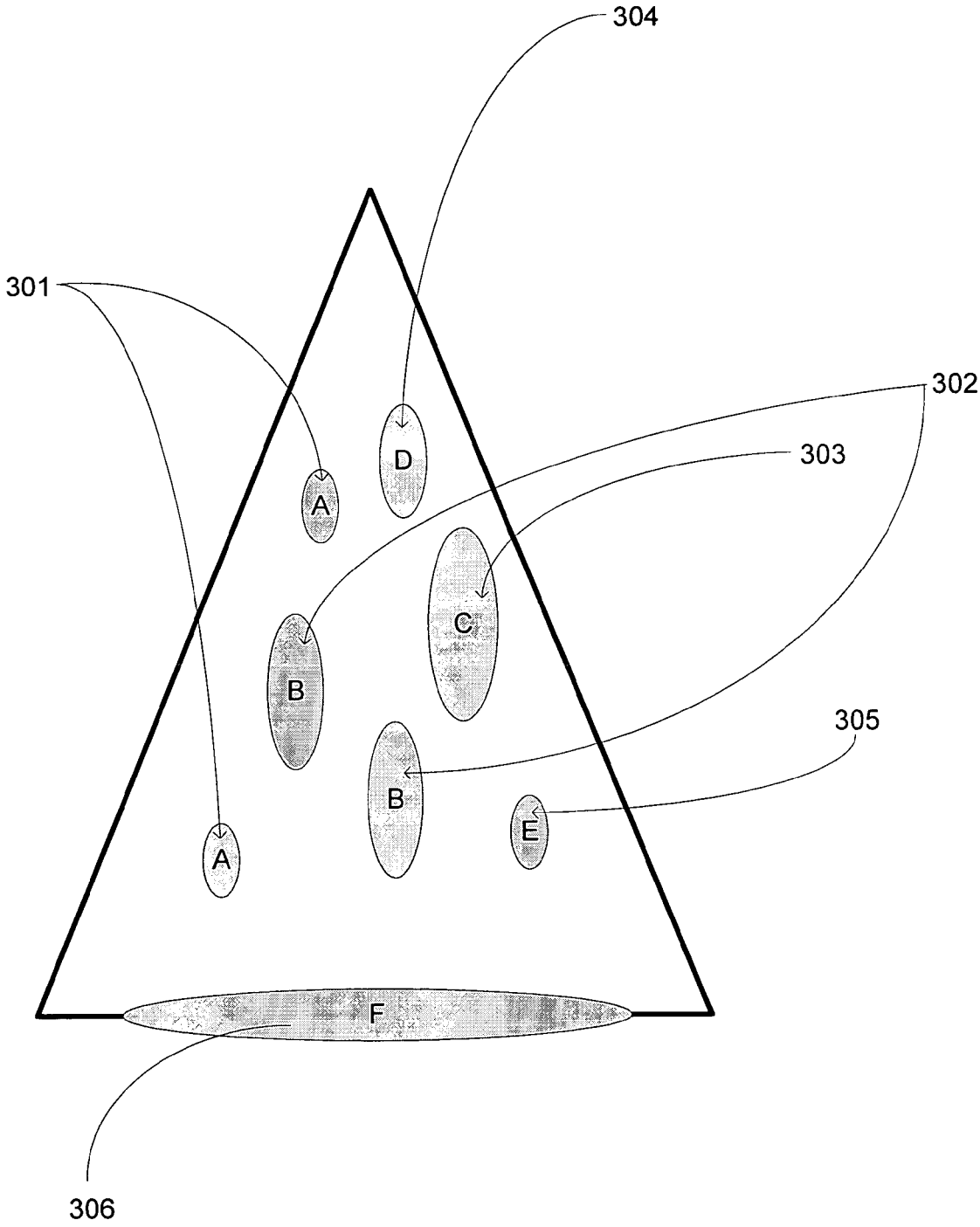
FIG. 3 is a detailed illustration of the apparatus receptacle panel openings of the present invention for the embodiment shown in FIG. 1.

A detailed view of the present design apparatus openings 103 in the receptacle panel 101 is illustrated in FIG. 3. In accordance with the present design, the openings 103 may be physically arranged and geometrically sized with the dimensions, proportions, and relative position to each other suitable for collecting only glasses in the eyewear receptacle 100 apparatus. Examples of elliptical opening sizes, presented in terms of major and minor axis dimensions to represent the relative size of the opening that may be suitable for use in the present design are provided in Table 1 and illustrated in FIG. 3 as opening A at point 301, opening B at point 302, opening C at point 303, opening D at point 304, opening E at point 305 and opening F at point 306.

Again, different shapes, quantities, and sizes may be employed, and different angles of opening orientation may be provided, but the values of Table 1 corresponding to the illustrations in FIG. 3 can be useful in assessing a general sizing trend between the eyewear dimensions and the openings provided. The present design may therefore include openings of other shapes, for example rectangles and circles and dimensions and proportions other than those prescribed in Table 1 for fulfilling the purposes of providing receptacle panel 101 openings 103. The present design may include one or more shapes, one or more shape dimensions and one or more shape proportions in forming each receptacle panel 101 or other comparable receiving apparatus.

TABLE 1

| OPENING | Ellipse Major Axis (inches) | Ellipse Minor Axis (inches) |
|---|---|---|
| A | 3¼ | 2 |
| B | 4½ | 3¼ |
| C | 5¼ | 3½ |
| D | 3½ | 2¼ |
| E | 2¾ | 1¾ |
| F | 21 | 2¾ |
| G | 4½ | 3 |

Beginning at the apparatus point of ingress or 'mouth', elliptically shaped openings 103 in conjunction with the shape of the supporting receptacle panels 101 may be configured to force the direction of travel for the returned glasses to easily pass downward and into the collection bin 102.

Figure 4A:
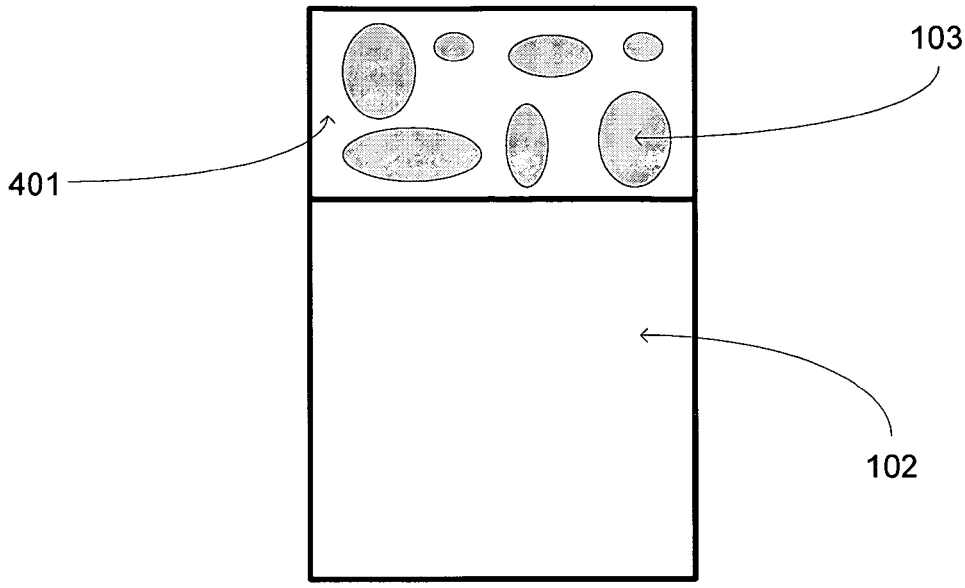
FIG. 4A is a side perspective view of an alternate embodiment of the present invention illustrating a rectangular shaped receptacle panel.

FIG. 4A illustrates a side view of an alternate embodiment of the present design where the apparatus may employ four rectangular shaped receptacle panels 401 in lieu of the triangular or pyramid shape design presented above. This embodiment may include a solid or blank panel to seal the top of the apparatus (not shown), or a top panel having openings similar to those shown, or some other arrangement. Although the receptacle panel 401 illustrated in FIG. 4A is configured to have vertically oriented sides parallel to collection bin 102, the present design may allow the receptacle panels 401 to be configured at other orientations relative to collection bin 102. For example, trapezoidal inwardly slanting panels may be employed with a flat panel top, outward flaring panels provided, or some other shape.

Figure 4B:
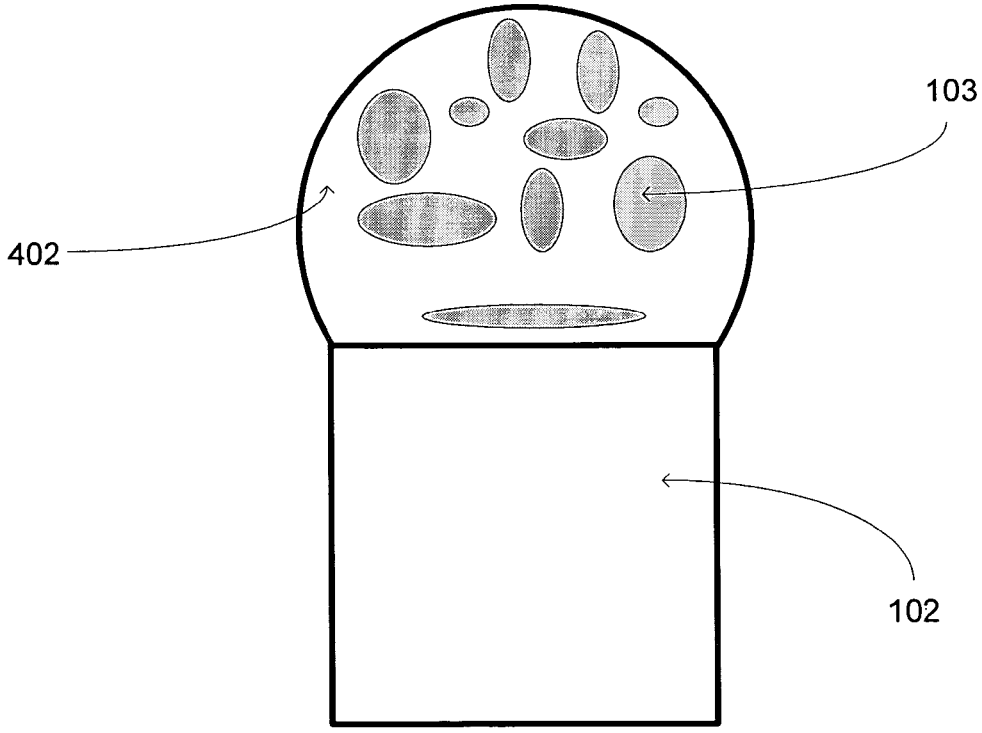
FIG. 4B is a side perspective view of another embodiment of the present invention illustrating a spherical shaped receptacle panel.

FIG. 4B illustrates a side view of another embodiment of the present design where the apparatus may employ a single spherically shaped receptacle panel 402. Although the receptacle panel 402 illustrated in FIG. 4B is configured to have a sphere larger in width than the width of collection bin 102, the present design may allow the receptacle panel 402 to be configured with different sizes relative to collection bin 102. For example, the single spherically shaped receptacle panel 402 may be smaller in diameter, equal to, or larger than collection bin 102. In addition, receptacle panel 402 may employ similar geometries that elongate the spherically shaped receptacle panel 402 in either the horizontal and/or vertical direction, or some other shape. The general functionality for each described embodiment remains the same, namely representing a top portion able to receive the eyewear, prohibiting certain large items from being deposited, and keeping items from being removed unless desired. The top portion and/or bottom portion or receptacle may be configured to have openings and receive the eyewear from patrons.

Figure 5A:
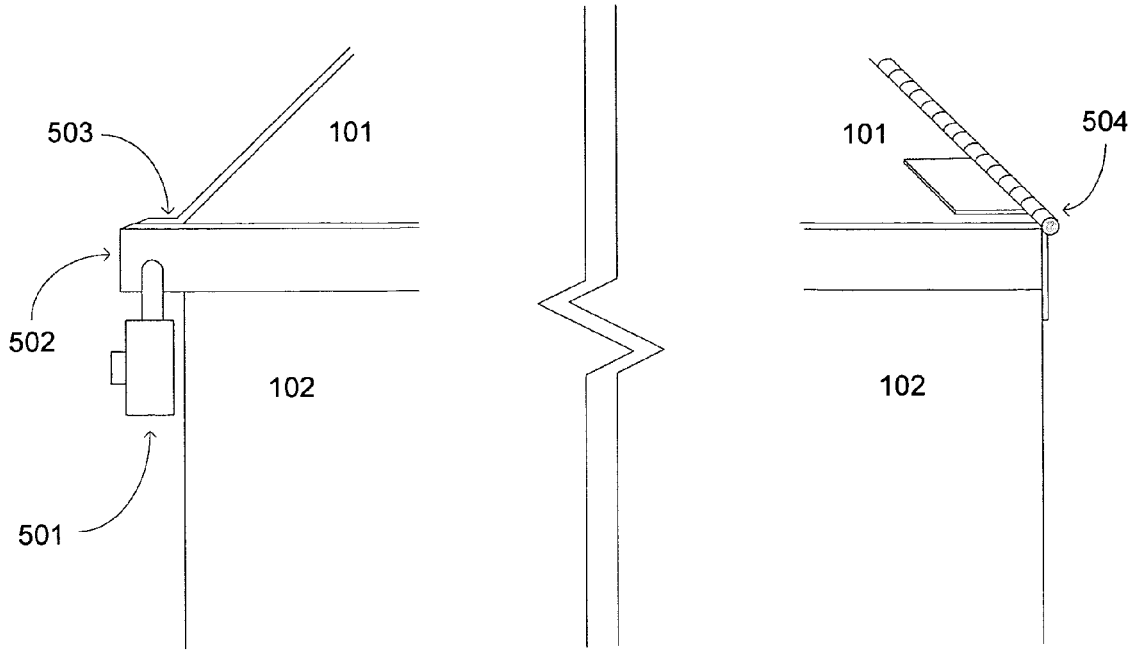
FIG. 5A is a detailed side perspective view of the apparatus arranged to align two independent latching members when the collection bin is closed and secured in accordance with the present design.

FIG. 5A illustrates a side perspective view of the present design locking mechanism. The present design may involve a locking mechanism for securing the eyewear receptacle 100 arrangement as illustrated in FIG. 5A. The locking mechanism may involve two independent latching members, one attached to the collection bin 102 at point 502 and the other attached to the receptacle panel 101 at point 503, configured to align openings within each latching member when the eyewear receptacle 100 is closed as shown in FIG. 5A. Aligning the openings may allow lock 501 to pass through an opening in each latching member. Once lock 501 passes through the latching member openings, lock 501 may be closed. Lock 501 may include a three-position combination lock, key lock, push-button lock, or other mechanical lockset or securing technology suitable for securely sealing and protecting eyewear receptacle 100.

In addition, eyewear receptacle 100 may include lock 501 integral with the collection bin or receptacle panel component. In this arrangement, securing the apparatus may involve operating the integral lock by placing it in the closed position when the eyewear receptacle is closed.

The present design may locate a hinge 504 on the opposite side of the eyewear receptacle 100. When lock 501 is removed, hinge 504 may allow the eyewear receptacle 100 to open and allow movie operators to remove returned eyewear. Hinge 504 may be a continuous hinge with a length equal to the length of one side of the collection bin 102, or may be one or more smaller hinges fixed along the edge of the collection bin 102. Although FIG. 5A illustrates hinge 504 as being located on the opposite side of the locking mechanism location, hinge 504 may be located on either the left or right side of eyewear receptacle 100.

Figure 5B:
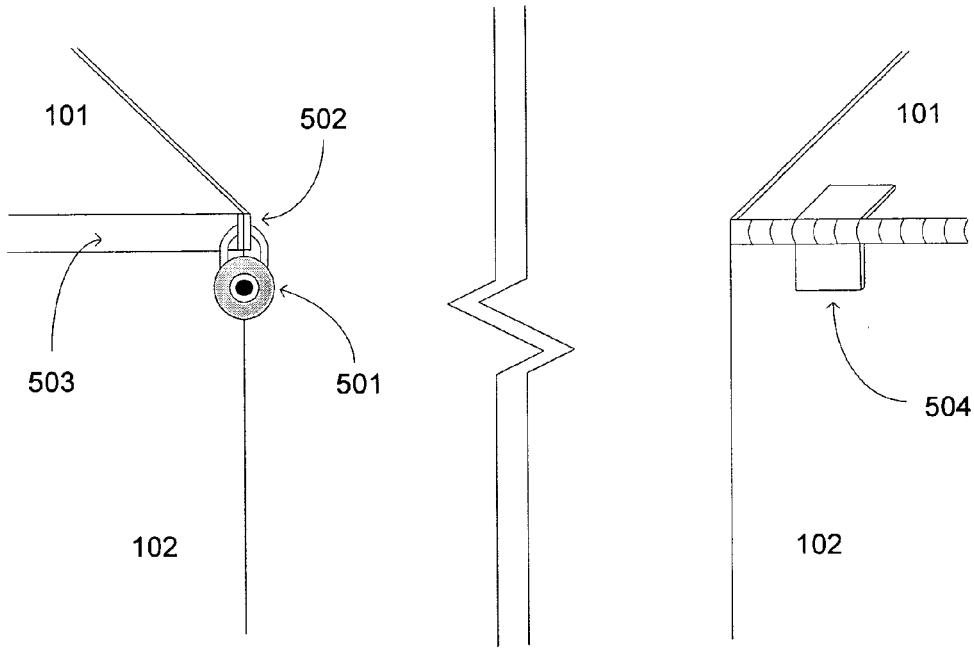
FIG. 5B is a front and back perspective view of the locking mechanism and the hinge arranged across the backside of the collection bin in accordance with the present design.

FIG. 5B illustrates a front and rear perspective view of one embodiment of a locking mechanism. The latching members at 502 and 503 may align when access door is closed. Aligning the latching members may arrange the openings in each locking member to become aligned. The openings in latching members 502 and 503 may be configured to allow lock 501 to pass through when the eyewear receptacle is closed. Latching member 502 may be affixed to the side of the collection bin 102 and latching member 503 may be affixed to the side of the receptacle panel 101. Once the lock 501 is passed through both latching members at 502 and 503 it may be closed securing the eyewear receptacle contents. In addition, FIG. 5B illustrates hinge 504 arranged across the backside of collection bin 102 and receptacle panel 101.

Although FIGS. 5A and 5B illustrate hinge 504 aligned horizontally along the top side of collection bin 102, the hinge 504 may be aligned along the either side of the eyewear receptacle in a vertical configuration or positioned in a manner sufficient to allow an operator to open the eyewear receptacle.

The collection bin may include other access components, including but not limited to sliding and/or locking panels or openings formed in the sides. If openable panels are provided, rather than the locking mechanism of FIGS. 5A and 5B, a lock may be placed on the panel or door opening. If, for example, a large hinged side door is provided to enable easy access to an internal collection bin sized as a standard shipping container.

As such a collection bin is generally bulky and difficult to move, if one side of the collection bin is intended to be placed against a wall, a simple opening that would face the wall under normal may be sufficient to allow access by venue personnel when removal of the contents was desired. In other words, a simple opening may suffice when venue personnel must make a significant effort, such as physically moving the heavy collection bin, to gain access to the opening.

Alternatively, the design may employ wheels, such as caster wheels, mounted on the bottom for easy movement. When a 3-D movie ends its run, the design can be easily moved from the theatre lobby space. Also, the unit can be moved into place at the end of the movie showtime to a prominent position so people can use the unit. The unit may or may not be positioned proximate a wall or vertical surface.

FIG. 6 illustrates one embodiment of the present design construction. The construction technique may be appropriate for attaching receptacle panel components to each other, for attaching receptacle components to the collection bin components, and attaching the sides, back, and bottom of the collection bin component to each other.

Figure 6A:
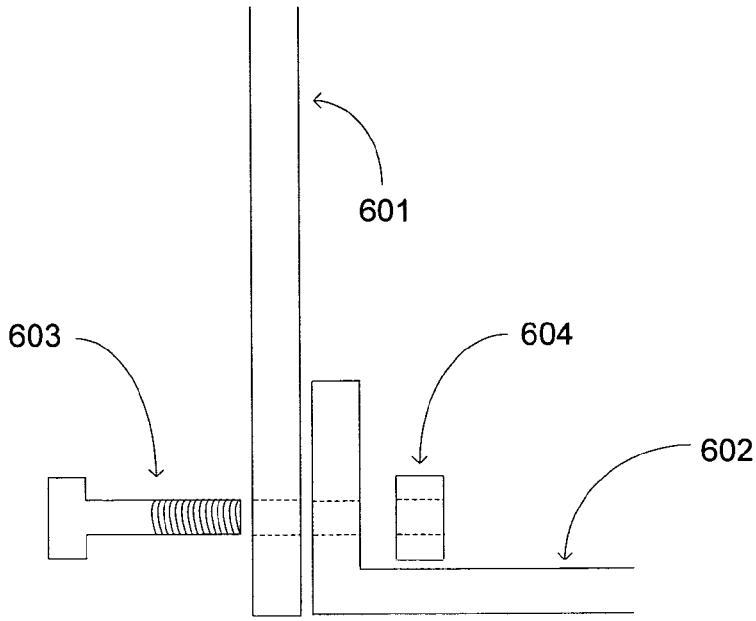
FIG. 6A is an illustration of a construction technique where a bolt is passed through aligned sides allowing a nut to be affixed in accordance with the present design.
Figure 6B:
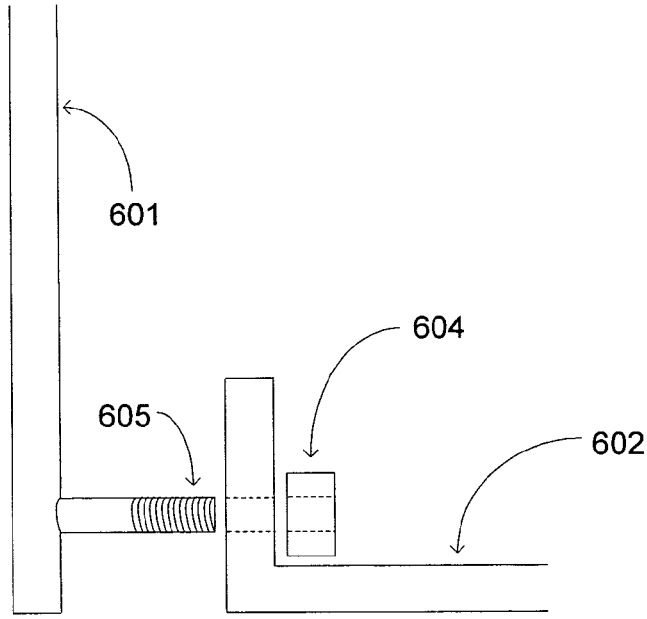
FIG. 6B is an illustration of an alternative construction technique where the bolt is an integral part of one side of eyewear receptacle in accordance with the present design.

Referring to FIG. 6A, the construction technique may involve a bolt 603 passing through an aligned first side 601 and second side 602 and may arrange all of the components sufficient to allow nut 604 to be affixed to bolt 603. FIG. 6B illustrates an alternative construction technique where bolt 605 in an integral part of first side 601. In this embodiment, first side 601 may be aligned with second side 602 configured to allow bolt 605 to pass through second side 602 and may arrange all of the components sufficient to allow nut 604 to be affixed to bolt 605. In a further embodiment, bolt 605 may be an integral part of the second side 602 configured to allow bolt 605 to pass through first side 601 and may arrange all the components sufficient to allow nut 604 to be affixed to bolt 605. In addition, the construction techniques used to build the present design may include welding or gluing at the seams or joints formed at the edges of the present design for the purposes of attaching the various components to each other, or any other construction technique suitable for attaching said components.

Eyewear Recycling Using Centralized Cleaning Facility

One aspect of the present design may include one or more localized receptacle components for collecting worn or soiled eyewear positioned within a venue such as a movie theater, a centralized cleaning facility where one or more eyewear washing machine components and, optionally, one or more packaging devices or components for sealing and protecting the clean eyewear from environmental exposure are available for use. As may be appreciated, where on-site cleaning facilities are provided, the present design employing a centralized cleaning facility may be augmented by on-site cleaning and/or simple recycling from the discarded location or bin to the distribution point of the venue. Thus the present design is not specifically exclusive to all other forms of recycling but may be employed in addition to other recycling methods.

Figure 7:
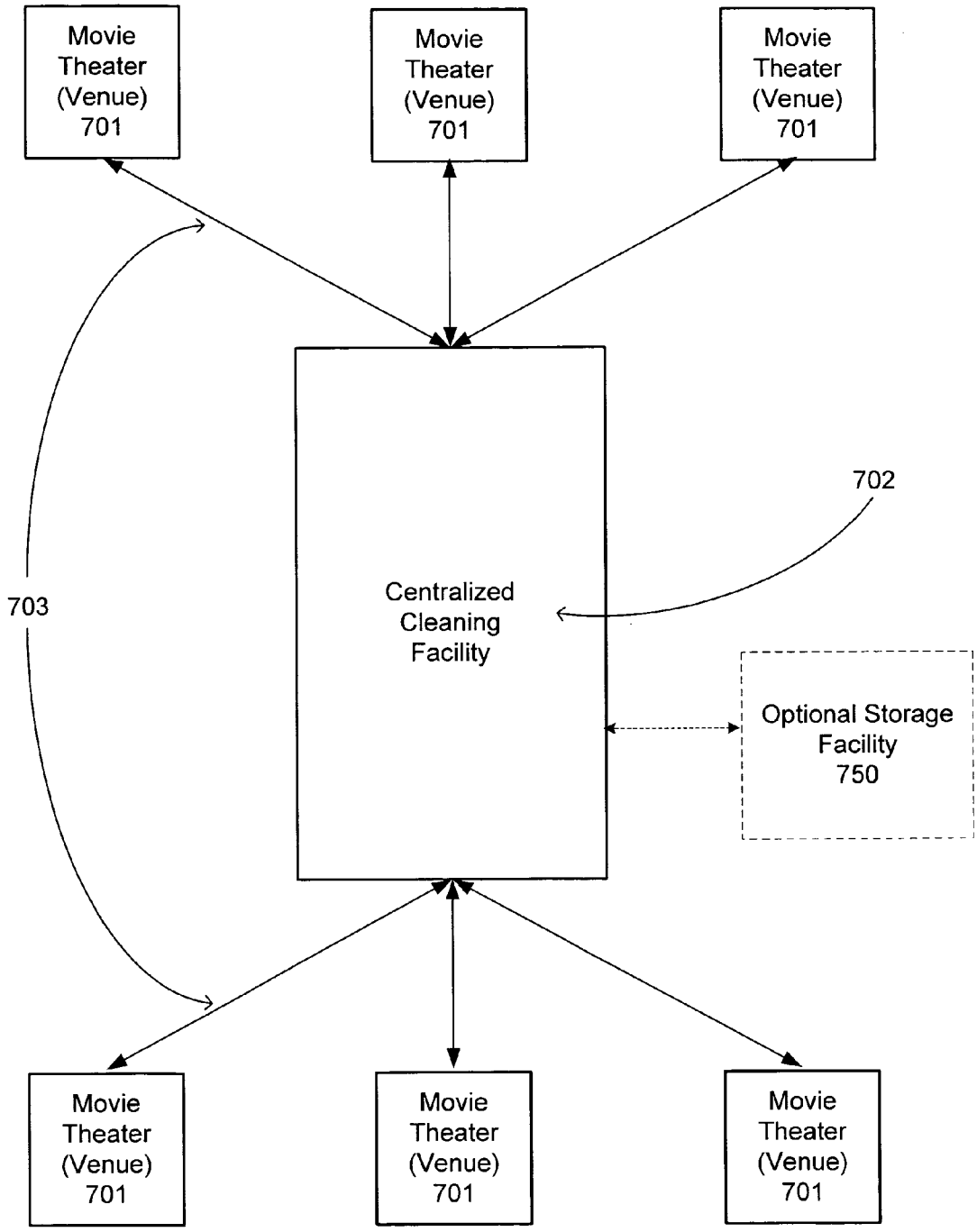
FIG. 7 is a block diagram illustrating centralized recycling of 3-D eyewear in accordance with the present design.

FIG. 7 is a block diagram illustrating centralized recycling of 3-D eyewear in accordance with the present design. The present design may provide for collecting worn eyewear at one or more locations, such as movie theaters 701, and transporting the worn eyewear to a remote centralized cleaning facility 702 via shipping path 703. The present design may be configured to wash the eyewear at the centralized cleaning facility 702. Eyewear may be optionally sterilized if desired, but a typical scenario entails simple washing of the eyewear. Clean eyewear may be packed and transported back to the venues or movie theaters 701 via shipping path 703. Clean eyewear received at the venues may be stored in a distribution container, ready for reuse.

Clean eyewear may be provided in an optional wrapping or other container, such as a plastic disposable wrapping that may include advertising imprinted thereon. Each venue may provide the eyewear to the centralized cleaning facility 702 using any type of available shipping via shipping path 703, including but not limited to the proprietor of the venue transporting the eyewear or having an employee transport the eyewear, or engaging a delivery service such as the US Post Office, United Parcel Service, or Federal Express or other shipping company or entity transport the eyewear to the central facility. Alternately, a separate entity may maintain the cleaning facility 702 and may provide for pickup of the eyewear by its employees or personnel specifically designated to make such a pickup. In this context, the proprietor of the cleaning facility 702 may be a venue owner or any person or entity wishing to offer the service so discussed.

Return of the eyewear from the cleaning facility 702 to the venue such as movie theater 701 via shipping path 703 may employ similar or identical transportation services, including but not limited to the venue sending a representative to pick up the cleaned or new glasses at the facility. The eyewear may be returned to the venue or movie theater using a delivery service (Post Office, DHL, etc.) or may be returned by the proprietor of the cleaning facility or his/her employees. Note that eyewear may be collected using one method via shipping path 703 and may be returned to the venue via the same or another shipping method as desired.

Optional storage facility 750 is provided, enabling eyewear to be stored. While shown as a separate entity interacting with centralized cleaning facility 702, in reality optional storage facility 750 may be located at centralized cleaning facility 702, and may ship directly to movie theatres/venues 701, or may receive shipments from movie theatres/venues 701, although those paths are not shown. More than one optional storage facility may be provided.

Note further that the cleaning facility may also employ recycling in terms of using certain parts such as discarded or mismatched temple pieces or used or mismatched lenses to make new complete eyewear sets, or even going so far as to melt down and reuse plastic or other eyewear material to make new eyewear. Such processes may be performed at the cleaning facility or off site, by the proprietor or by a third party. Thus the cleaning facility may do more than simply clean the used eyewear.

Figure 8:
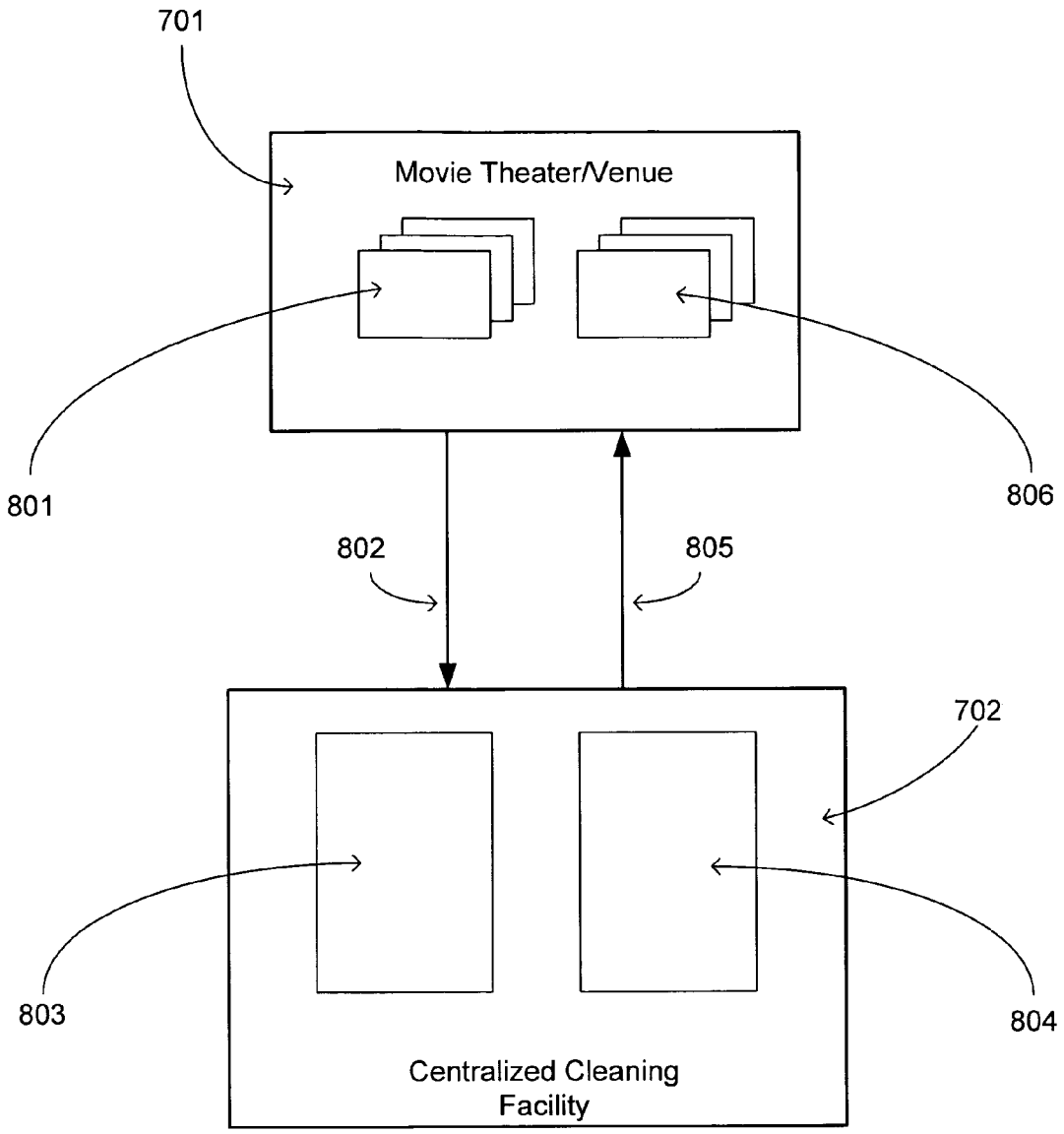
FIG. 8 illustrates the workflow for one embodiment of a 3-D eyewear recycling system in accordance with the present design.

FIG. 8 illustrates one embodiment of a 3-D eyewear recycling apparatus and method in accordance with the present design. In this embodiment the present design may be configured to collect previously worn 3-D eyewear at one or more venues movie theaters 701 using one or more localized eyewear receptacles 702. Eyewear collected at movie theaters via receptacle 801 may be aggregated and packaged to prepare the eyewear for shipping or transport to one or more centralized cleaning facilities 702 via shipping path 802. 3-D eyewear received at the centralized cleaning facilities 702 may be unpacked and placed into an eyewear washing mechanism 803. After the eyewear washing mechanism 803 completes the cleaning cycle, the eyewear may be removed from the washer and readied for packaging at 804. Each pair of 3-D eyewear may be placed into a pouch, bag, tube or other suitable protective enclosure configured to provide a level of protection from the environmental elements and to keep the eyewear clean. The packaged eyewear at 804 may be aggregated and prepared for shipping, destine for transport to one or more movie theaters 701. Eyewear received at the movie theater 701 may be placed in a distribution container 806 ready for reuse.

The benefit of the present design is in the requirements placed on the venue operator. Without the current design, a venue operator who periodically washed eyewear using a device such as an on-site dishwasher/washing machine would need personnel to collect eyewear, filter out trash and/or broken pieces, bring the eyewear to the washing site, wash the eyewear, take the eyewear from the wash site, and distribute the eyewear. While a single person might be able to perform all these functions, the number of man-hours required was significant, and this was required at each and every venue site. The economy of the present design is the ability to only require each venue to have personnel to collect the glasses and place them in a designated area and to retrieve or obtain incoming glasses and distribute them to the patrons. This requires significantly less time or man-hours for each venue. While time is required to perform the transportation and washing illustrated in FIG. 7, economies of scale can be realized and fewer man-hours required, as persons can be dedicated to a particular task. Using the on-site approach, if a single individual employee is solely tasked with washing glasses, i.e. manning the dishwasher and removing broken pieces, many venues would not have the volume of eyewear to keep the individual busy for an eight hour shift, and thus the costs associated with maintaining such a worker for the task would be high. If the worker is asked to perform tasks other than washing glasses to supplement his or her workload, time would be required moving from task to task. Further, the cost of equipment, including maintenance thereof, is not insignificant and thus harms the venue owner's bottom line. In sum, the proposed centralized collection and cleaning function can significantly improve the venue owner's revenue while continuing to offer 3-D movies to patrons.

Figure 9:
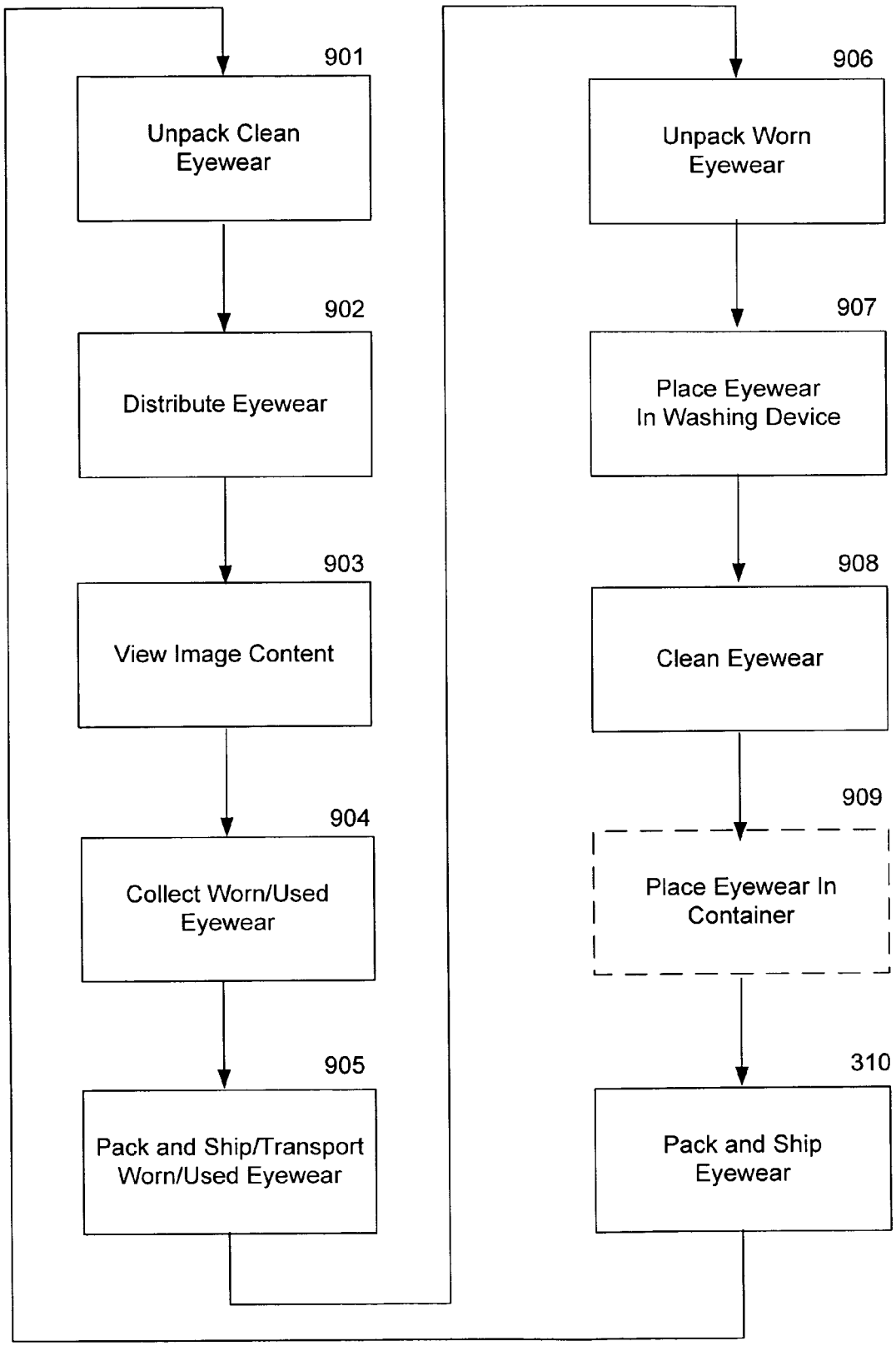
FIG. 9 is a flowchart illustrating a process flow for recycling 3-D eyewear in accordance with the present design.

FIG. 9 is a flowchart illustrating a process flow for recycling 3-D eyewear in accordance with the present design. The present design may return clean eyewear to the movie theaters 701 and the eyewear may be unpacked at point 901. Eyewear may be stored in a dedicated container, for example located at or near the theater entrance, ready for distribution to newly attending audience members. As audience members enter the theater, operators may distribute the ready-for-use cleaned eyewear at point 902. At point 902, patrons may alternately purchase an admission ticket and be provided with eyewear with their ticket purchase. Audience members may wear the eyewear while they view 3-D stereoscopic image content at point 903. After viewing stereoscopic image content, the present design may collect worn eyewear at 904 as audience members leave the theater. At this point, the movie theater operators may request departing audience members to place their worn and soiled eyewear into a localized receptacle, for example, located at or near the theater exit, such as the receptacle described herein.

At the end of the business day, or other appropriate business cycle, theater operators may empty the previously worn eyewear from one or more localized receptacles in order to collect the eyewear and may package and ship the worn eyewear at point 905 to a centralized cleaning location 702. At the centralized washing facility, the worn eyewear may be unpacked at point 906 and placed into a eyewear washing machine at point 907, for example, an autoclave, an ultrasonic machine, pressure washer, or other washing device and may use a disinfectant, soap, or the like for the purpose of cleaning the eyewear at point 908. After the washing machine or device completes the process of cleaning and optionally drying at point 908, the resulting cleaned eyewear may be packaged in individual containers or packages at 909. Individual containers may protect the eyewear from environmental exposure and may ensure the eyewear remain clean. For example, packaging may include a self-sealing pouch, bag, tube, wrap, and other containers or enclosures to protect the eyewear from contamination. Eyewear packaged at the centralized cleaning facility may be shipped and returned to the originating movie theaters 701 at point 310.

Figure 10:
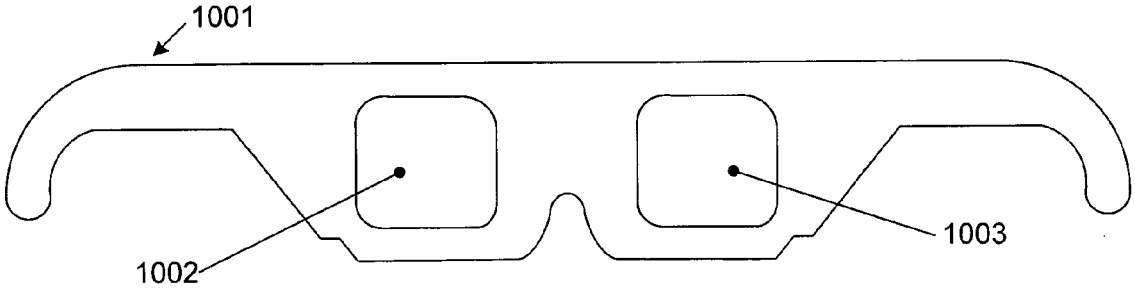
FIG. 10 illustrates a pair of 3-D eyewear in accordance with the present design.
Figure 11:
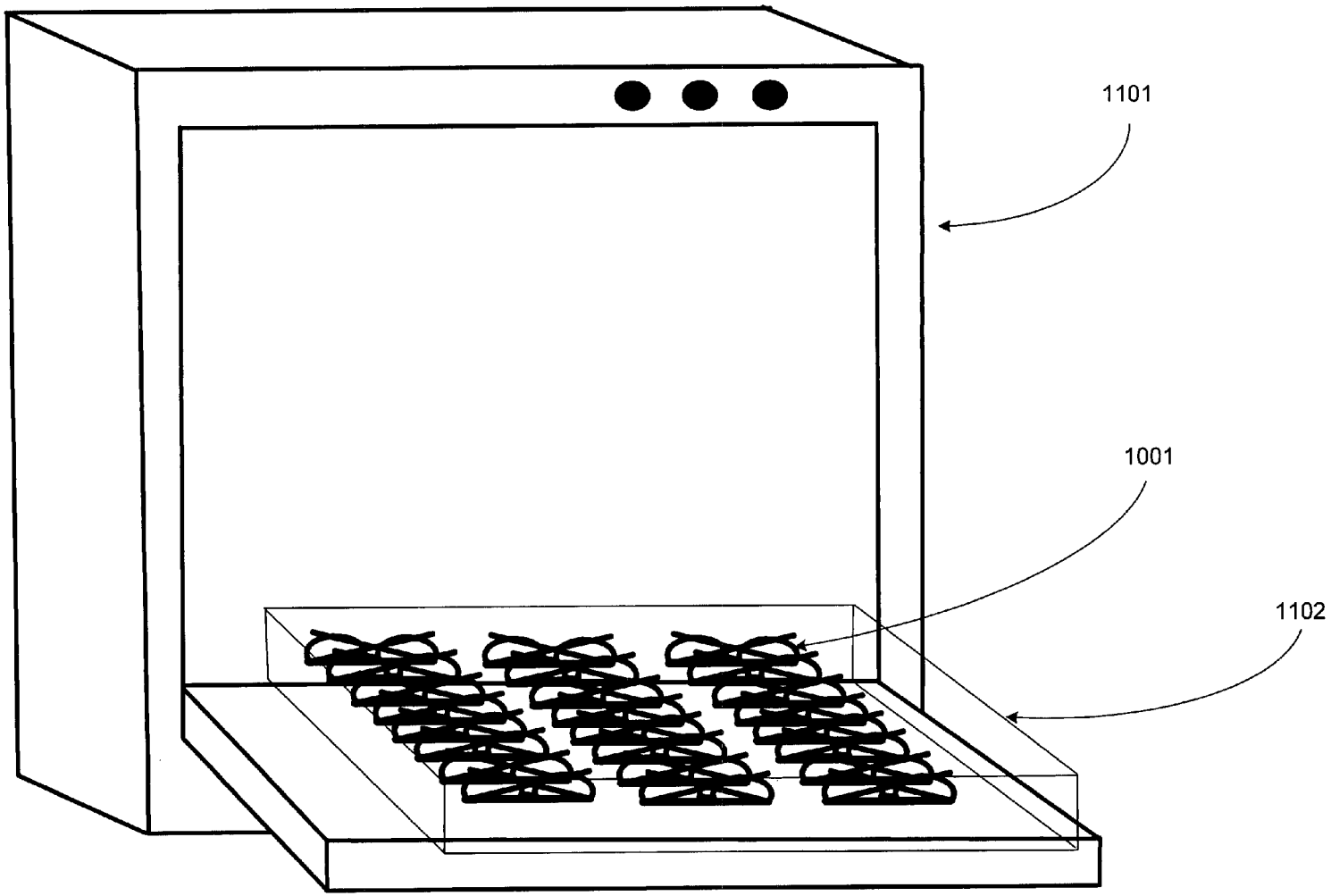
FIG. 11 illustrates an eyewear washing machine in accordance with the present design.

FIG. 10 illustrates a pair of 3-D eyewear in accordance with the present design. 3-D eyewear may include active and passive selection devices and may include linear and circular polarizing optics at 1002 and 1003 and constructed using cardboard, paper, plastic, plastic-framed or other kinds of eyewear at 1001. FIG. 11 illustrates an eyewear washing machine or device 1101 in accordance with the present design wherein the washing machine or device may employ a conveyor belt but is generally flat and slides or is movable into the washing mechanism. 3-D eyewear 1001 may be arranged on a tray 1102 prior to washing. Alternately, eyewear washing machine or device 1101 may be a hanging type system, similar to a dry cleaning type system where multiple glasses are hung on a multiple bar hanger with hooks. Other washing mechanisms may be employed.

Multiple washing machines or devices may be employed at a centralized cleaning facility, and more than one centralized cleaning facility may be available depending on circumstances. While a washing device is depicted here, it is to be understood that washing or cleaning may be accomplished without using a machine or washing device, including but not limited to washing by hand or other available cleaning technique.

It should be noted that all eyewear is not necessarily transported nor cleansed in the manner suggested, but selected eyewear may be collected, transported, cleaned and returned. Different scenarios may result in some eyewear being retained at the venue and not transported to the cleaning facility, selected eyewear may be cleaned while other eyewear is discarded due to age, wear, or otherwise being unusable, outdated, or unacceptable, and certain eyewear, even though cleaned may not be returned to any collection facility for various reasons, including but not limited to a diminished need for eyewear at venues serviced by the collection facility. Certain eyewear may simply not be cleaned, for example eyewear provided in the collection bin that has not been removed from a protective wrapper. In this case, the cleaning facility personnel may simply transport the eyewear back to a venue without cleaning the eyewear. However, it is expected that the vast majority of eyewear will be selected, collected, transported, cleaned, and returned, while some eyewear may not have some of the listed procedures occur depending on circumstances.

Further, it is to be noted that eyewear may not be returned from the same facility from which it originates, unless for example some reason is provided to do so, such as venue owner request or the name of the venue or other indication is provided on or with the eyewear. Also, while it is implied that the cleaning facility is remote or separate from the venues, in reality the centralized facility may be located at a venue, such as when the venue has sufficient space and personnel to clean the eyewear in the manner disclosed.

The design presented herein and the specific aspects illustrated are meant not to be limiting, but may include alternate components while still incorporating the teachings and benefits of the invention. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. An apparatus for collecting selection devices, comprising:

a collection bin component comprising a removable internal collection bin configured to accumulate selection devices;

a receptacle lid component configured to be located above the collection bin component, said receptacle lid component comprising a plurality of openings, the receptacle lid configured to be employed above the removable internal collection bin along a first direction, a first grouping of the plurality of openings being positioned along a first common plane of the receptacle lid parallel to the first direction, each of the plurality of openings positioned substantially above the collection bin component and the removable internal collection bin, and a second grouping of the plurality of openings being positioned along a second common plane of the receptacle lid perpendicular to the first common plane; and directing elements, each extending from an intersection between upper edge corners of the collection bin component and the receptacle lid component toward the removable internal collection bin, wherein the openings include openings of at least two different sizes that are arranged in said receptacle lid component in proportions configured to receive the selection devices and enable the removable internal collection bin to collect the selection devices deposited through any of the plurality of openings.

2. The apparatus of claim 1, wherein the openings are arranged in shape, proportion, and relative position configured to accept the deposit of the selection devices.

3. The apparatus of claim 1, wherein the openings are configured in various shapes and proportions to prevent undesirable articles from being passed through the openings.

4. The apparatus of claim 1, wherein the collection bin and receptacle lid component are configured to enable selection devices to fall a material distance from the lowest openings in the receptacle lid component, thereby preventing retrieval of the selection devices from the collection bin by average unaided persons.

5. The apparatus of claim 1, further comprising signage associated with the apparatus indicating selection devices may be deposited in the apparatus.

6. An apparatus for collecting and storing selection devices, comprising:

a collection bin component housing a removable internal collection bin;

a receptacle lid component having a plurality of openings, the receptacle lid configured to be employed above the removable internal collection bin along a first direction, a first grouping of the plurality of openings being positioned along a first common plane of the receptacle lid parallel to the first direction, each of the plurality of openings positioned substantially above the collection bin component and the removable internal collection bin, and a second grouping of the plurality of openings being positioned along a second common plane of the receptacle lid perpendicular to the first common plane; and a signage component forming a visually distinctive appearance associated with the receptacle receiving component, wherein the plurality of openings are arranged on the receptacle lid component in proportions configured to receive the selection devices and enable the removable internal collection bin to collect the selection devices deposited through any of the plurality of openings.

7. The apparatus of claim 6, wherein the signage component further comprises arranging at least one picture, images, symbol, color, text and other verbal element configured to indicate deposit of used eyewear.

8. The apparatus of claim 6, wherein the openings are shaped, proportioned, and positioned to receive returned 3-D selection devices and simultaneously prevent materially differently sized material and debris from being received.

9. The apparatus of claim 6, wherein the signage components are positioned on the apparatus.

10. The apparatus of claim 6, wherein the openings and receptacle receiving component are configured to direct travel of the selection devices toward the collection bin.

* * * * *